United States Patent [19]

Haagenson

[11] 4,095,503

[45] Jun. 20, 1978

[54] MUSICAL INSTRUMENT

[76] Inventor: Carl Haagenson, 13212 Magnolia, No. 134, Garden Grove, Calif. 92644

[21] Appl. No.: 752,142

[22] Filed: Dec. 20, 1976

[51] Int. Cl.[2] ..... G10D 1/02

[52] U.S. Cl. ..... 84/173; 84/307

[58] Field of Search ..... D56/1 A; 84/170, 173, 84/263, 290, 291, 292, 294

[56] References Cited

U.S. PATENT DOCUMENTS

| | | | |
|---|---|---|---|
| D. 163,347 | 5/1951 | Badkin | D56/1 A |
| D. 235,372 | 6/1975 | Hebbert | D56/1 A |
| 1,808,103 | 6/1931 | Fischer | 84/173 |

*Primary Examiner*—Lawrence R. Franklin

[57] ABSTRACT

A novel musical instrument is provided which comprises a resonance body member, a bridge, a neck piece, a tailpiece, a neck stabilizer and a tailpiece stabilizer all in combination with the resonance body member. A variable can size adjustment means is provided whereby body members of different lengths and sizes may be utilized.

6 Claims, 3 Drawing Figures

MUSICAL INSTRUMENT

The present invention relates generally to musical instruments and the like and more particularly to a novel device for holding and containing resonance drums of varying sizes. The device of the invention may be utilized to provide a simple and inexpensive musical instrument to be utilized by those relatively unskilled in the art.

There are many different bass-type musical instruments in the art and most of them are expensive and are difficult to master to those unskilled in the art. There is a need to provide an instrument which can contain and hold a resonance body member, i.e. a drum which is very inexpensive and easily obtainable.

Additionally, there is a need in the art to provide a device whereby the drum or resonance member can be of different shapes and sizes. Thus, one can utilize an instrument to contain a drum such as a gasoline drum, a pan, or a metal trash can, which are utilized as the resonating body to amplify the vibrations of the strings. In this manner, utilizing the invention, one can inexpensively construct a musical instrument. Thus the musical art can be expanded to include those who otherwise cannot afford the expense of a musical instrument. Additionally, there is a need in the art whereby a device can be provided to contain resonating members of various shapes and sizes.

Accordingly, one object of the invention is to provide an inexpensive bass musical instrument. Another object is to provide a musical instrument to accommodate various sizes and shapes of the resonating member. Other objects of the invention will be apparent from the following description.

Figure 1:
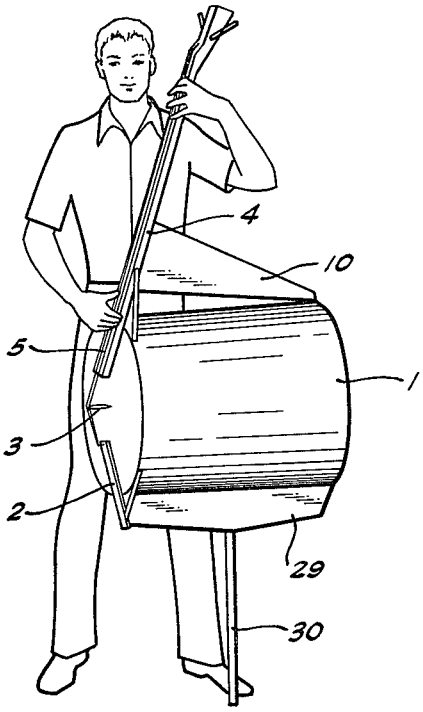
FIG. 1 is a perspective view showing an overall representation of the invention as utilized by the operator but without regard to some of the details of the invention which will be described herein.

Basically, as shown in FIG. 1, the invention comprises a resonance body member 1 having a closed side wall and closed end piece. The closed end piece is the end of member 1 which is in communication with the bridge 3 and the strings 5. Tailpiece 2 has tailpiece stabilizer 29 and stand pin 30 connected thereto. Neck piece 4 is attached to the neck piece stabilizer and to the body member 1.

The resonating body member 1 can be any resonating body such as a can, pan or drum. A trash can may, for example, be utilized in the invention. Thus, one can simply take a trash can and convert it, with the aid of this invention, to a useable musical instrument. One advantage in the invention is that there need be no alterations to the can or holes or indentations placed in the can or body member. As can be seen by the drawings and this description, body members of varying sizes and shapes may be utilized and thus cans or drums of different sizes may be substituted as the user desires.

Figure 2:
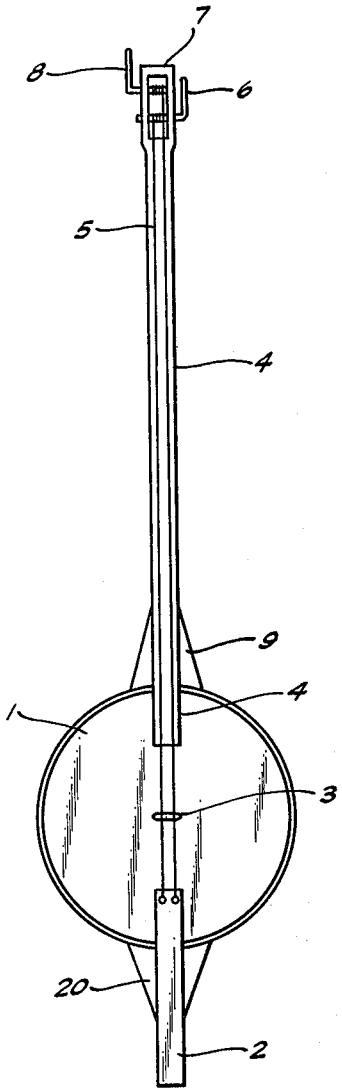
FIG. 2 is a front view of the invention.
Figure 3:
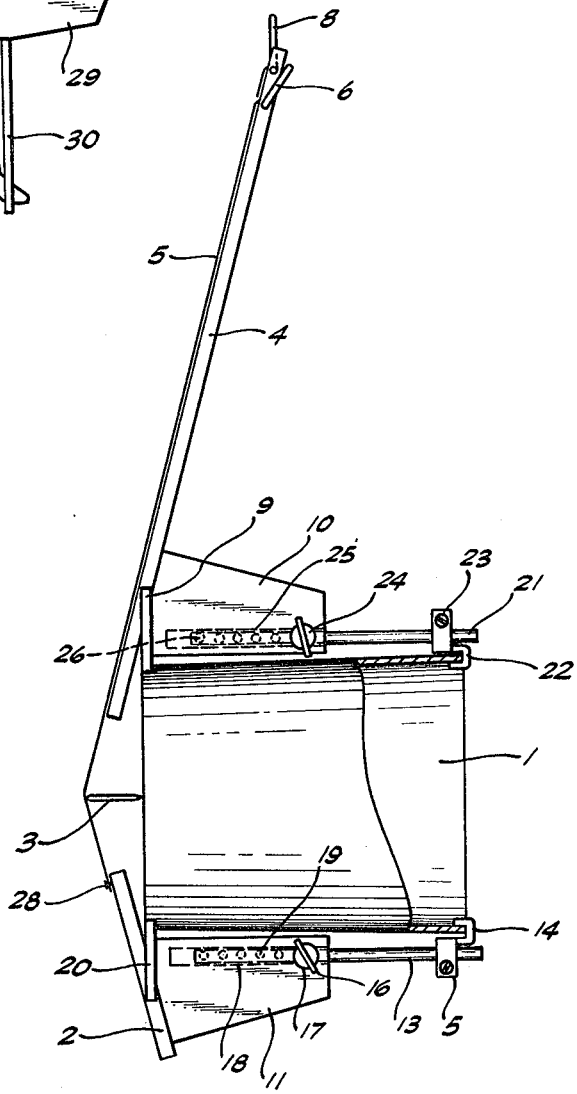
FIG. 3 is a side view, partially in section, of the invention.

Resonance body member 1 is shown in FIGS. 2 and 3 resting on hook 14 and tail piece bearing block 20. Tail piece bearing block 20 is attached to tail piece 2 which, as shown, is at an angle of about 10°–30° vertically from the body member. Attached to the tail piece are strings 5 which assists in keeping the body member in place from the tension of the strings. Strings 5 extend from the tail piece up to and around tuning pins 6 and 8 enclosed within the pin box 7. In the preferred embodiment of FIGS. 2 and 3, the tension of the musical strings along with the hooks 14 and 22 and the tail piece bearing block 20 and the neck bearing block 9 maintain the resonance body member in position.

Neck piece 4 extends substantially vertically from the body member and at an angle of about 10°–45° vertically towards the body member. Connected to the neck piece is the neck bearing block 9 which rests on the body member 1. Neck stabilizer 10 is shown connected to the neck. The tail piece stabilizer and the neck piece stabilizer shown as part 29 and part 10 in FIG. 1, along with the other shown attachments such as the bridge 3 in FIG. 1, can maintain the body member 1 in place. In the preferred embodiment of FIG. 3, hooks 22 and 14 hold the body member in place. Hook 22 is shown attached to a variable can size adjustment bar 21 utilizing clamp 23. The bar is shown inserted into neck stabilizer 10 with openings 26 in the bar. Holding pin 24 is shown and, when inserted through one of the holes 26, maintains the bar in place at the desired lateral position. In this fashion the lateral distance of the hook 22 from the neck piece can be maintained at the desired distance. In this fashion, body members of varying sizes can be utilized with the same neck, stabilizer and other parts of the instrument.

Hook 14 is shown in communication with the variable can size adjustment bar 13. Holding pin 16 is shown inserted through a hole in bar 13 to hold the bar within the tail piece stabilizer at the desired lateral pisition. As shown in FIG. 3, three or more holes are drilled in the bar so that the pin may be inserted in one of the holes at the desired lateral position. In this fashion, hooks 14 and 22 can be set at variable lateral positions to accommodate body members of differing sizes. This unique feature of the invention permits utilization of different resonance body members.

Strings 5 are shown extending from the tail piece at pins 28 up to and about the tuning pins 6 and 8. The tuning pins, of course, maintain the strings in the desired tension. The tension of the strings operate in conjunction with the bridge 3 to maintan the body member in the desired position laterally.

FIG. 1 shows a stand pin 30 utilized for positioning the instrument on the ground. FIG. 3 shows tail piece 2 on the ground and thus the stand pin is an optional feature of the invention.

A unique feature of the invention is bridge 3. As indicated above, it serves to maintain the body member in position utilizing the tension of the strings and also to serve as a head or apex so that the strings can be diverted on to tail piece 2. The bridge causes the vibrations of the strings to be conducted to a point on the center of the end wall of the body member. Bridge 3 is held in tension by the tension of the strings. The bridge has to a slightly rounded edge at the end which is in contact with the closed end piece of the resonance body member. Such a slightly rounded bridge has advantages over the blunt-end bridge in that the quality of the sound is improved by a slightly rounded bridge end. The brdige rolls slightly when the string is plucked sideways because of its configuration, thus preventing unnecessary noises and disturbances. A sharp-pointed bridge is also preferrable but a slightly rounded pointed edge is most preferred.

I claim:

1. A stringed musical instrument, comprising:

a body member having a closed end and an oppositely directed open end; a bridge supported by said closed end;

a neck piece having connected thereto bearing means adapted to rest on said body member adjacent said closed end and stabilizer means releasably connected to said body member adjacent said open end;

a tailpiece having connected thereto second bearing means adapted to rest on said body member adjacent said closed end and second stabilizer means releasably connected to said body member adjacent said open end;

at least one tuning means mounted on said neck piece; and at least one string being fastened to said tailpiece, extending over said bridge and neck piece, and being fastened to said tuning means, the tension in said string maintaining both of said bearing means in contact with said body member.

2. An instrument as in claim 1 wherein both of said stabilizer means includes adjustment means for permitting other, variably sized body members to be substituted for said body member.

3. An instrument as in claim 2 wherein said adjustment means comprises a stabilizer piece, a bar having a hook connected thereto, and means for connecting said bar to said stabilizer piece in variable positions to locate said hook at selectable, variable distances from said closed end.

4. An instrument as in claim 1 wherein both of said stabilizer means includes hooks releasably connected to said open end.

5. An instrument as in claim 1 wherein said bridge rests on said closed end and is maintained in position by said string tension.

6. An instrument as in claim 5 wherein said bridge has a slightly rounded edge resting on said closed end.

* * * * *